US007464503B2

(12) United States Patent
Hoberman

(10) Patent No.: US 7,464,503 B2
(45) Date of Patent: Dec. 16, 2008

(54) GEARED EXPANDING STRUCTURES

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 1022 days.

(21) Appl. No.: 10/743,273

(22) Filed: Dec. 22, 2003

(65) Prior Publication Data

US 2004/0134157 A1 Jul. 15, 2004

Related U.S. Application Data

(60) Provisional application No. 60/439,938, filed on Jan. 14, 2003.

(51) Int. Cl.
*E04B 7/08* (2006.01)

(52) U.S. Cl. ..... 52/81.1; 52/645

(58) Field of Classification Search ..... 52/81.1, 52/646, 645; 135/143
See application file for complete search history.

(56) References Cited

U.S. PATENT DOCUMENTS 4,026,313 A * 5/1977 Zeigler ..... 135/143
4,589,236 A 5/1986 McAllister
4,627,210 A * 12/1986 Beaulieu ..... 52/646
4,838,003 A * 6/1989 Zeigler ..... 52/646
4,970,841 A * 11/1990 Zeigler ..... 52/646
4,986,016 A * 1/1991 Wichman ..... 40/610
4,998,552 A * 3/1991 Niksic et al. ..... 135/136
5,024,031 A 6/1991 Hoberman
5,117,852 A 6/1992 Bryant
5,363,627 A 11/1994 Wilson
7,125,015 B2 * 10/2006 Hoberman et al. ..... 273/153 S

* cited by examiner

*Primary Examiner*—Basil Katcheves
(74) *Attorney, Agent, or Firm*—Gottlieb, Rackman & Reisman

(57) ABSTRACT

A folding linkage is hereby disclosed that is comprised of four links, each link having a bevel gear on its end, where each link is in geared contact with a neighboring link, such that both links are held together by a hub element that is small relative to the two links. An alternate embodiment of the invention has links that have a spur gear on each end, whereby each gear end is engaged with a central rack (linear gear).

15 Claims, 16 Drawing Sheets

GEARED EXPANDING STRUCTURES

This application is based on provisional application Ser. No. 60/439,938, filed Jan. 14, 2003.

BACKGROUND OF THE INVENTION

U.S. Pat. No. 5,024,031, hereby incorporated by reference as if fully disclosed herein, teaches methods for constructing transformable truss-structures in a variety of shapes. The teachings therein have been used to build structures for diverse applications, including architectural uses, public exhibits and unique folding toys.

One group of embodiments disclosed in the U.S. Pat. No. 5,024,031 patent is expanding structures that are made up of scissor-pairs—linear structural elements that are pinned together by a centrally located pivot. Such scissor-pairs are joined to one another either directly, or via pairs of "hub elements" that attach scissors that lie in different planes. All members of such expanding structures are thus "doubled", whether as strut-pairs or as hub pairs.

The reason for doubling these elements is to synchronize the movement of the structure. Without such pairing of these members, the structure would tend to be "floppy", its movement would be ill-determined.

This type of structure, while advantageous, can nonetheless be improved. In particular, the parts required to build a particular structure are more numerous than for an equivalent structure that is not transformable, i.e. static. Therefore, it would be of benefit to provide for a transformable structure with a reduced part count.

SUMMARY OF INVENTION

In accordance with the present invention, a new way to build expanding structures that do not require the doubling of the members is provided. Rather, the structures utilize structural elements that function as single members which are attached to one another via single hub elements.

This discovery utilizes a geared connection between strut members where they are connected by hub elements. This gearing of the members synchronizes their relative movement so that the structure can expand and contract in a smooth manner.

Thus, a key benefit of this invention is a reduction in the number of individual elements as compared with those structures disclosed in the U.S. Pat. No. 5,024,031 patent.

The inventive system has a second useful feature as well. For structures disclosed in the '031 patent, they move between a contracted state and expanded state. As the structure expands, its members rotate approximately ninety degrees. When the structure is fully expanded, the members are prevented from rotating further because the hub elements contact each other.

According to the current invention, structures are disclosed such that its members rotate approximately one hundred and eighty degrees. Thus, the structure goes to a contracted state where its members are orthogonal to the overall surface and to an expanded state where its members are parallel to the overall surface. The structure can then be continuously folded again so that it reaches a second, unique contracted state.

This unusual ability to "flip" between two unique folded states allows for structures to be built that completely transform their color and shape.

A folding linkage is thus hereby disclosed that is comprised of four links, each link having a bevel gear on its end, where each link is in geared contact with a neighboring link, such that both links are held together by a hub element that is small relative to the two links. An alternate embodiment of the invention has links that have a spur gear on each end, whereby each gear end is engaged with a central rack (linear gear).

Folding structures made up of a matrix of such linkages are further disclosed that can expand and contract synchronously. Such structures have the two unique folded states where in one folded state a given set of gear-ends and hubs lie on the outer surface of the structure, and in a second folded state a complementary set of gear-ends and struts lie on the outer surface. Moreover, although the inventive loop assembly includes four links additional links may be added so long as the total number of links are even in number.

It is an object of the invention to provide an improved foldable linkage.

Another object of the invention is to provide a linkage system which expands and contracts.

Yet a further object of the invention is an improved linkage having a plurality of links in geared contact with one another.

Still other objects and advantages of the invention will, in part, be obvious and will, in part, be apparent from the following description.

BRIEF DESCRIPTION OF DRAWINGS

For a fuller understanding of the invention, reference is made to the following description, taken in connection with the accompanying drawings in which.

DESCRIPTION OF THE EMBODIMENTS

Figures 1, 2, 3, 4, 5:
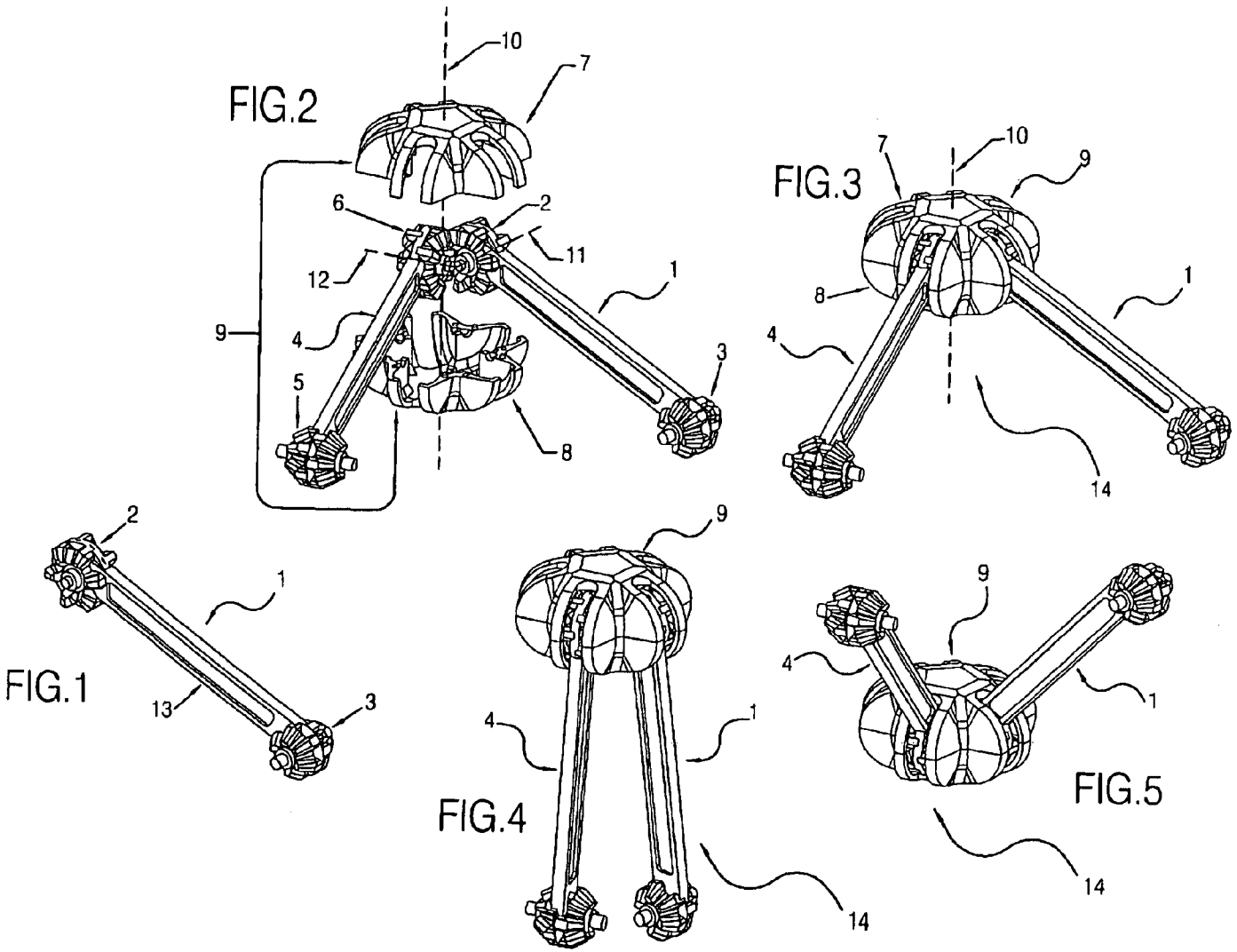
FIG. 1 is a perspective view of a geared link made in accordance with the invention.
FIG. 2 is an exploded perspective view of a pair of pivotally engaged gear links in accordance with the invention.
FIG. 3 is a perspective view similar to FIG. 2 and showing a hub retaining the engaged gear ends.
FIG. 4 is a perspective view illustrating a different rotational position of the engaged link pairs shown in FIGS. 2 and 3.
FIG. 5 is a perspective view showing a further rotational position of the engaged link pairs of FIGS. 2 and 3.

FIG. 1 shows a link 1 which is comprised of a linear structural element 13 having two geared ends 2 and 3, each consisting of two bevel gears joined back-to-back.

FIG. 2 shows two links 1 and 4 whose respective gear ends 2 and 6 are engaged with one another. A line 11 is shown oriented along the axis of gear end 2. A second line 12 shown oriented along the axis of gear end 6. Lines 11 and 12 lie in a common plane. A vector 10 which is orthogonal to that plane is shown.

FIG. 2 also shows an exploded view of a hub element 9 which locates and retains links 1 and 4. Hub element 9 is comprised of two halves 7 and 8 which are oriented such that line 10 forms their central vector.

FIG. 3 shows an assembly 14 comprised of links 1 and 4 as well as hub 9. Hub 9 is shown in an unexploded view where halves 7 and 8 have been joined together thereby retaining links 1 and 4 such that their respective gear ends 2 and 6 are engaged with one another. Also shown is central line 10 lying orthogonal to the primary plane of hub 9.

FIGS. 4 and 5 show the assembly 14 where links 1 and 4 have been rotated to two different positions relative to hub 9.

Figure 6:
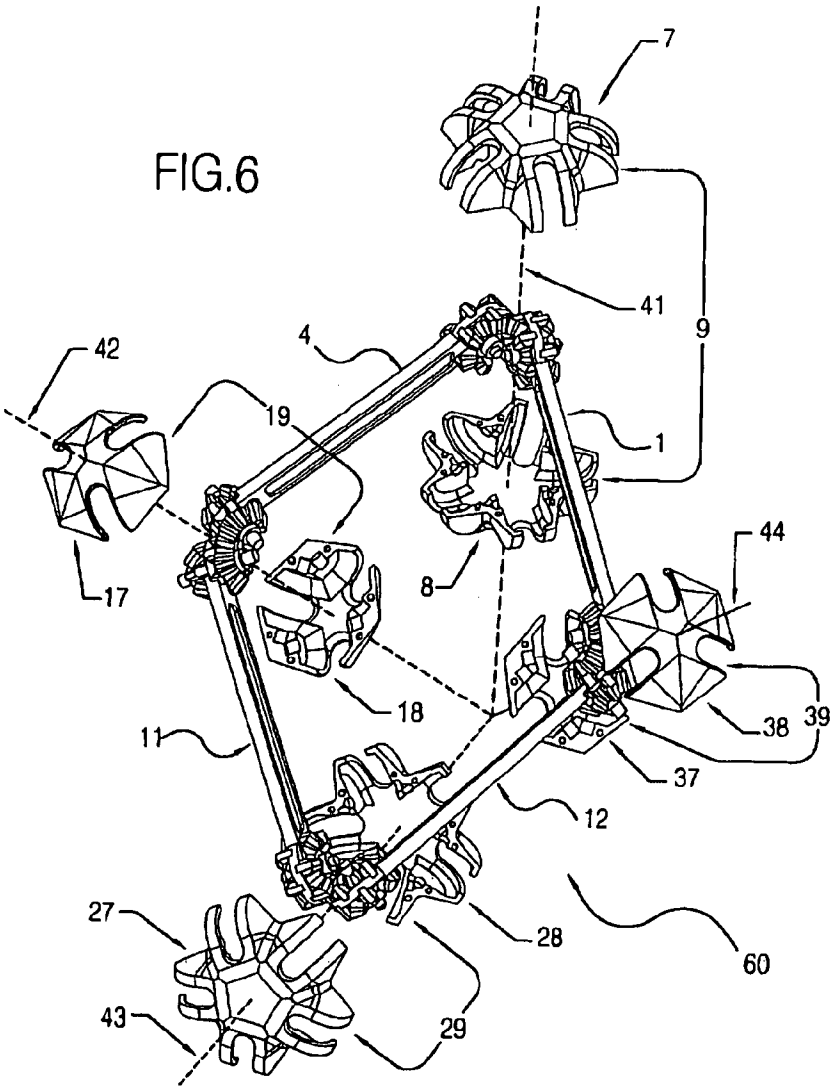
FIG. 6 is an exploded perspective view of a loop assembly made in accordance with the invention.

FIG. 6 shows an exploded view of loop assembly 60 which is comprised of four links 1, 4, 11 and 12 and four hubs 9, 19, 29 and 39. Two gear ends of link 1 are engaged respectively with the gear ends of links 4 and 12. Likewise the two gear ends of each of the other links are engaged with those of their neighboring links. Hub 19 is comprised of two halves 17 and 18 which are oriented along central vector 42. Similarly hubs 29, 39 and 9 are comprised respectively of halves 27-28, 37-38 and 7-8 which are in turn oriented respectively along central vectors 43, 44 and 41.

Figure 7:
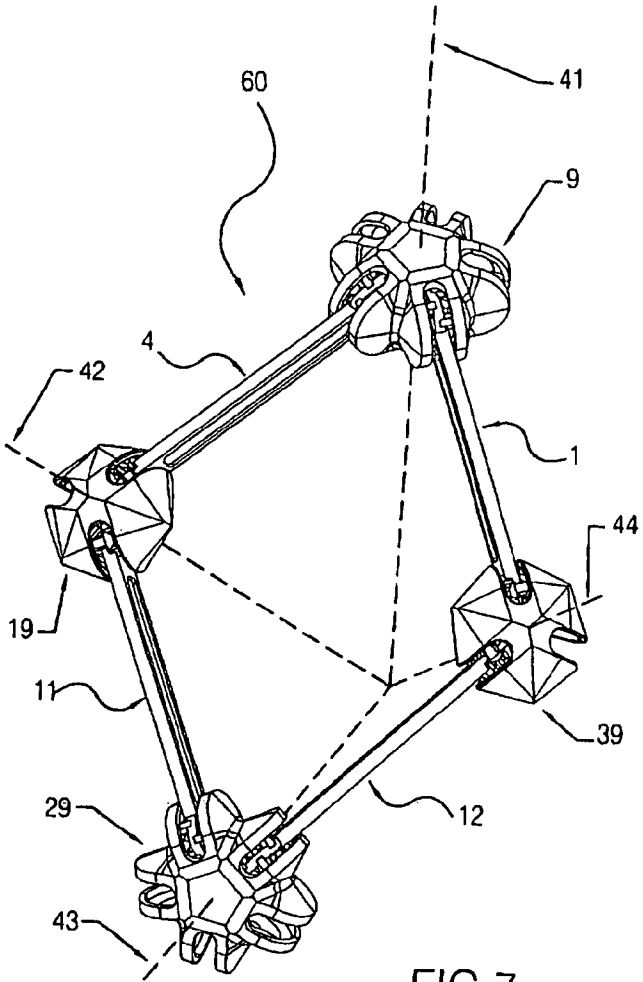
FIG. 7 is an unexploded perspective view of the loop assembly shown in FIG. 6.

FIG. 7 shows loop assembly 60 in an unexploded view where hubs 9, 19, 29 and 39 retain links 1, 4, 11 and 12 in geared contact.

Figures 8, 9, 10:
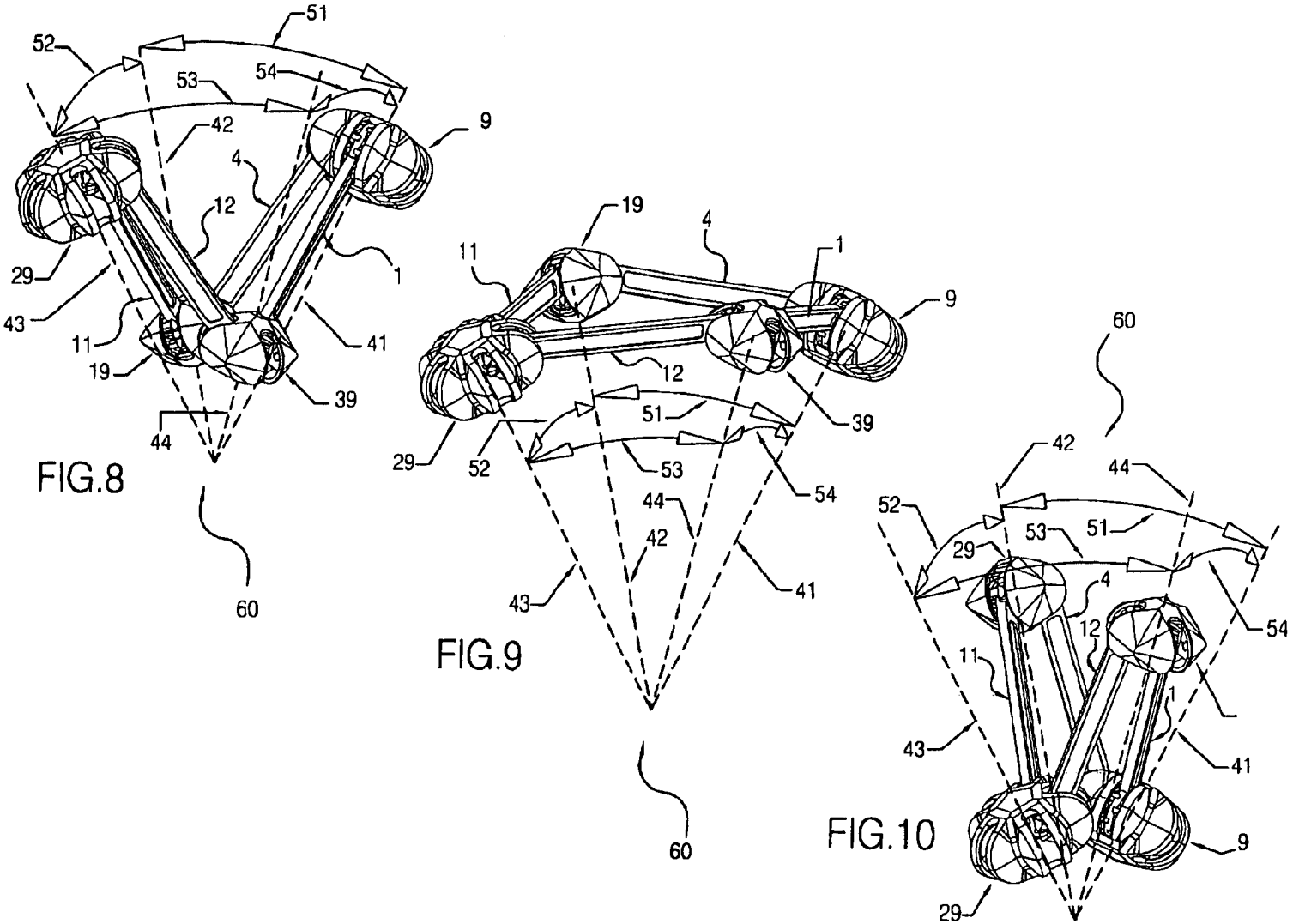
FIG. 8 is a perspective view of the loop assembly of FIGS. 6 and 7 shown in one folded condition.
FIG. 9 is a perspective view of the loop assembly of FIGS. 6 and 7 shown in a first unfolded condition.
FIG. 10 is a perspective view of the loop assembly of FIGS. 6 and 7 shown in a second folded condition.

FIG. 8 shows another view of loop assembly 60 in a folded position such that hubs 19 and 39 are in close proximity. Central vectors 41 and 42 form an angle 51 between them. Central vectors 42 and 43 form an angle 52 between them. Likewise central vectors 43-44 and 44-41 form angles 53 and 54 respectively.

FIG. 9 shows loop assembly 60 in an unfolded position. Central vectors 41, 42, 43 and 44 form angles 51, 52, 53 and 54 in similar fashion to those described in FIG. 8. The angles thus formed are identical to those formed by the folded loop assembly shown in FIG. 8.

FIG. 10 shows loop assembly 60 in an alternate folded position such that hubs 9 and 29 are in close proximity.

Central vectors 41, 42, 43 and 44 form angles 51, 52, 53 and 54 in similar fashion to those described in FIGS. 8 and 9. The angles thus formed are identical to those formed by the folded loop assembly shown in FIGS. 8 and 9.

Figure 11:
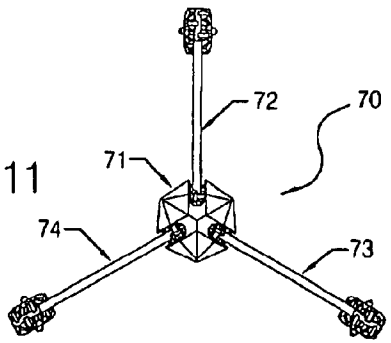
FIG. 11 is a plan perspective view of a three-way hub and link assembly made in accordance with the invention.

FIG. 11 shows a plan view of an assembly 70 comprised of a hub 71 which retains three links 72, 73 and 74 in geared contact. Such a hub will be hereinafter referred to as a three-way hub.

Figure 12:
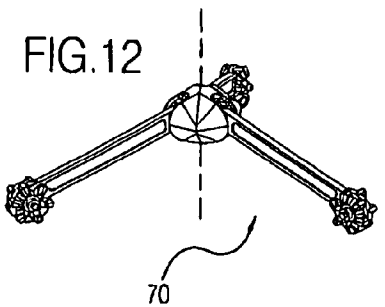
FIG. 12 is a perspective view of the three-way hub and link assembly of FIG. 11 in a first folded condition.
Figure 13:
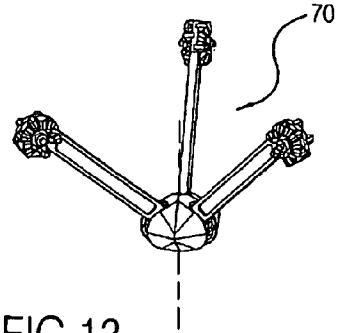
FIG. 13 is a perspective view of the three-way hub and link assembly of FIG. 11 in a second folded condition.

FIGS. 12 and 13 show perspective views of assembly 70 with its three links rotated in two alternate positions.

Figure 14:
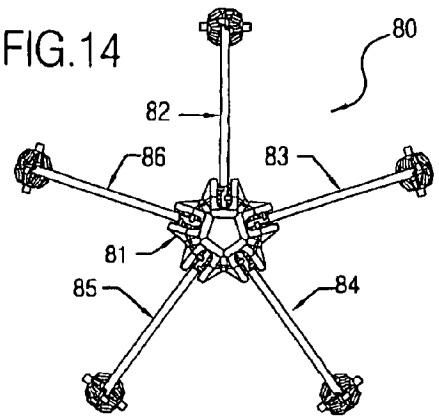
FIG. 14 is a plan perspective view of a five-way hub and link assembly made in accordance with the invention.

FIG. 14 shows a plan view an assembly 80 comprised of a hub 91 which retains five links 82, 83, 84, 85 and 86 in geared contact. Such a hub will be hereinafter referred to as a five-way hub.

Figure 15:
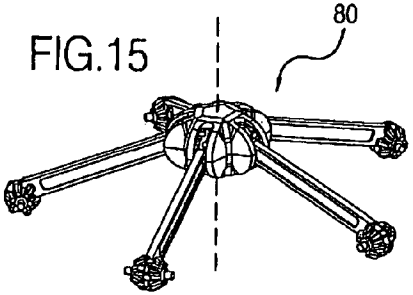
FIG. 15 is a perspective view of the five-way hub and link assembly of FIG. 14 in a first folded condition.
Figure 16:
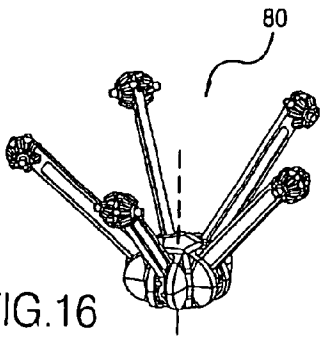
FIG. 16 is a perspective view of the five-way hub and link assembly in a second folded condition.

FIGS. 15 and 16 show perspective views of assembly 80 with its five links rotated in two alternate positions.

Figure 17:
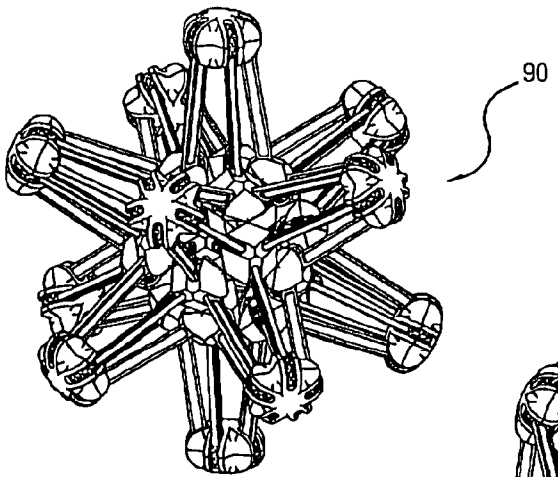
FIG. 17 is a perspective view of a structure comprising a multiplicity of loop assemblies in accordance with the invention.

FIG. 17 shows a structure 90 which is comprised of a multiplicity of loops assemblies. Structure 150 is comprised of thirty links, twenty three-way hubs and twelve five-way hubs. Structure 90 is in a folded position such that the twelve five-way hubs are in close proximity.

Figure 18:
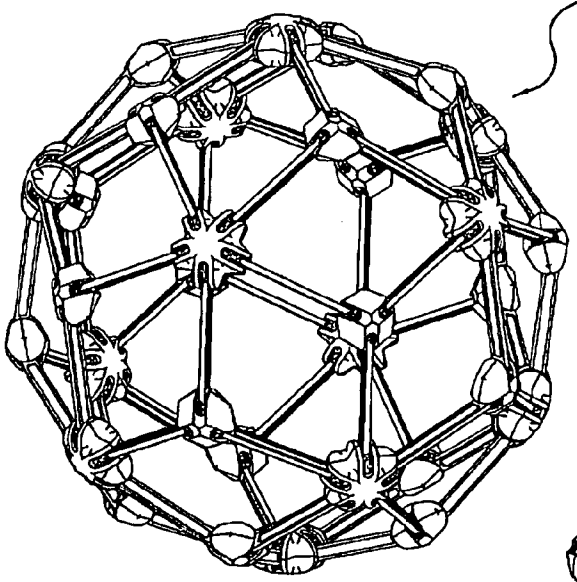
FIG. 18 is a perspective view of the structure of FIG. 17 in an unfolded condition.
Figure 19:
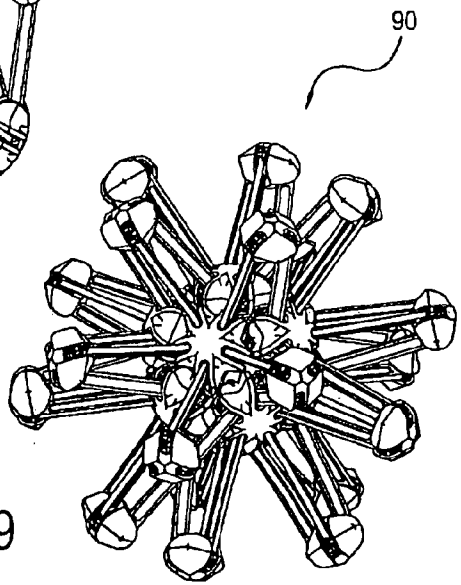
FIG. 19 is a perspective view of the structure of FIG. 17 in a folded condition.

FIG. 18 shows structure 90 in an unfolded position. FIG. 19 shows structure 90 in an alternate folded position such that the twenty three-way hubs are in close proximity.

Figure 20:
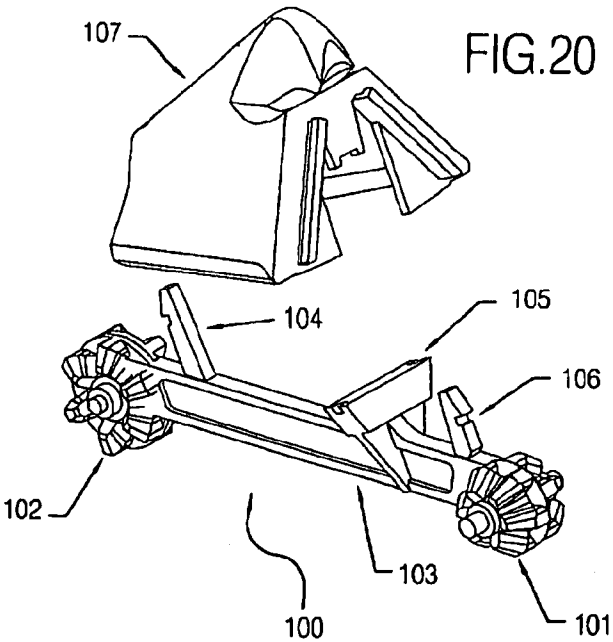
FIG. 20 is an exploded perspective view of an alternative link structure made in accordance with the invention.

FIG. 20 shows an alternate structure 100 of a link with gear ends. Structure 100 is comprised of a of a linear structural element 103 having two geared ends 101 and 102, each consisting of two bevel gears joined back-to-back. Additionally, there are three attachment features 104, 105 and 106. Shown above link 100 is a covering element 107.

Figure 21:
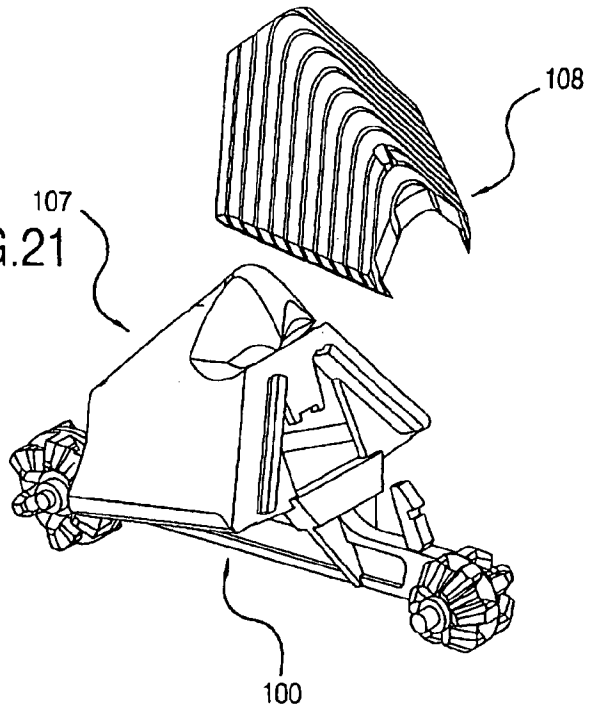
FIG. 21 is an exploded perspective view of the structure of FIG. 20 in which a second covering element is shown.

FIG. 21 shows the covering element 107 having been attached to link 100 via features 104 and 105. Shown above link 100 is a second covering element 108 which has a surface that is differentiated from element 107—in this case being striped.

Figure 22:
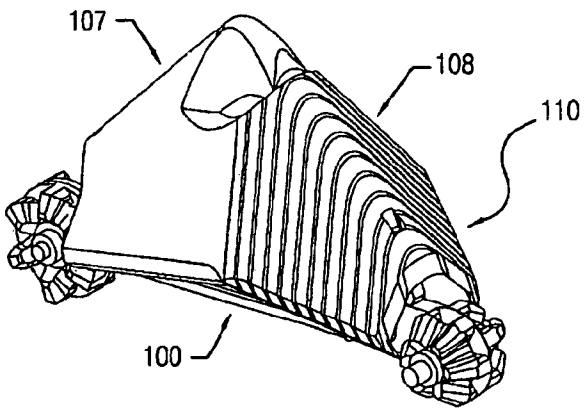
FIG. 22 is a perspective view of the structure of FIGS. 20 and 21 in which both covering elements have been applied.

FIG. 22 shows elements 100, 107 and 108 having been attached together to make a covered link 110.

Figure 23:
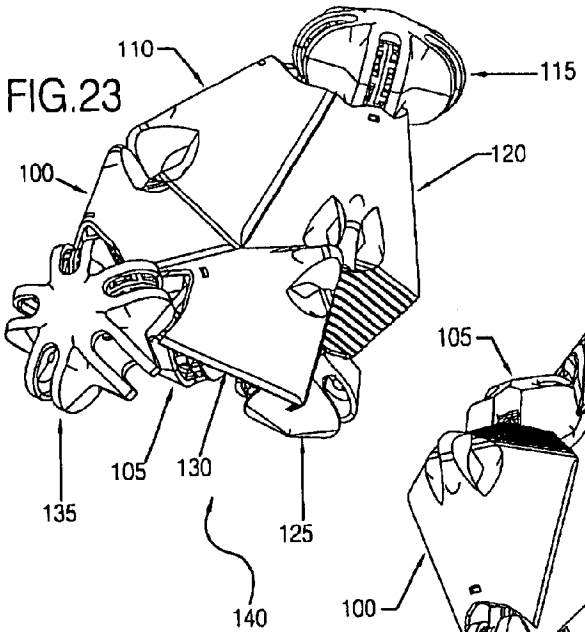
FIG. 23 is a perspective view of a loop assembly consisting of four covered links with interconnecting hubs.

FIG. 23 shows a loop assembly 140 consisting of four covered links 110, 120, 130 and 140 and four hubs 105, 115, 125 and 135. Assembly 140 is shown in a folded position such that hubs 105 and 125 are in close proximity. It may be seen that the exposed portion of the covering elements are unstriped.

Figure 24:
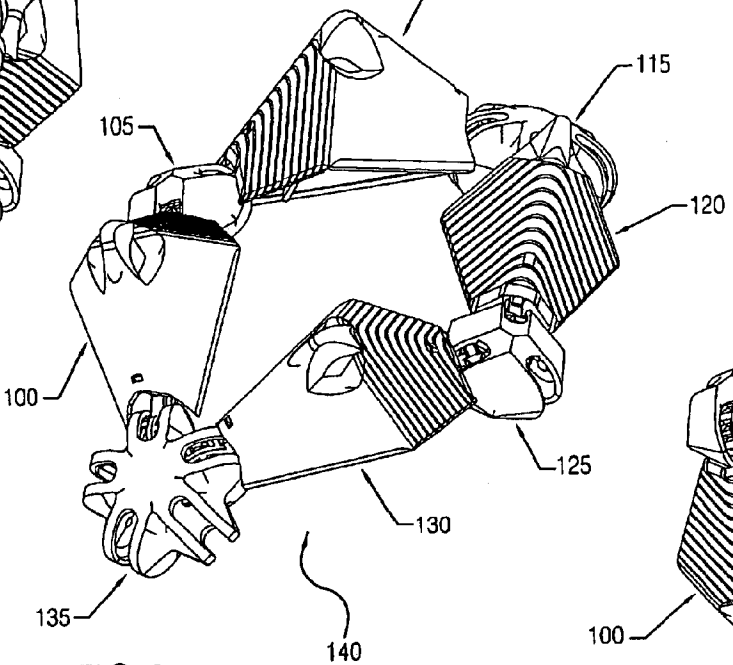
FIG. 24 is a perspective view of the loop assembly of FIG. 23 in an unfolded condition.
Figure 25:
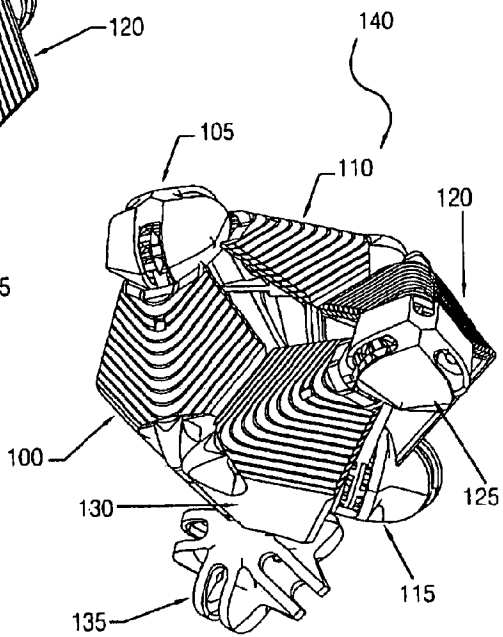
FIG. 25 is a perspective view of the loop assembly of FIG. 23 in a folded condition.

FIG. 24 shows loop assembly 140 in an unfolded position. It may be seen that both the unstriped and striped portions of the covering elements are exposed. FIG. 25 shows loop assembly 140 in an alternate folded position whereby hubs 115 and 135 are in close proximity. It may be seen that the exposed portion of the covering elements are striped.

Figure 26:
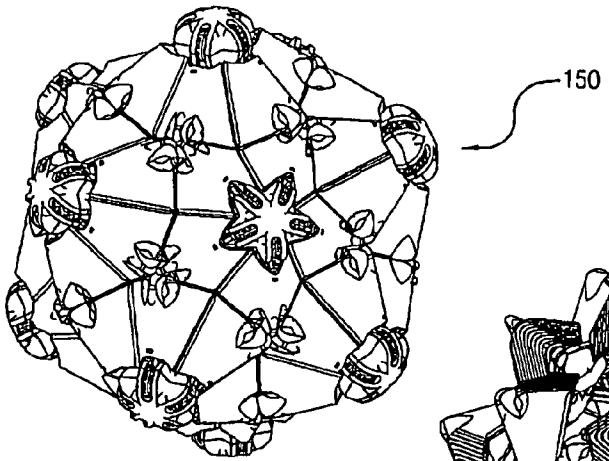
FIG. 26 is a perspective view of a further alternative structure in accordance with the invention.

FIG. 26 shows a structure 150 which is comprised of thirty covered links, twenty three-way hubs and twelve five-way hubs. Structure 150 is in a folded position such that the unstriped portions of the covered links are exposed, whereas the striped portions of the covered links are hidden.

Figure 27:
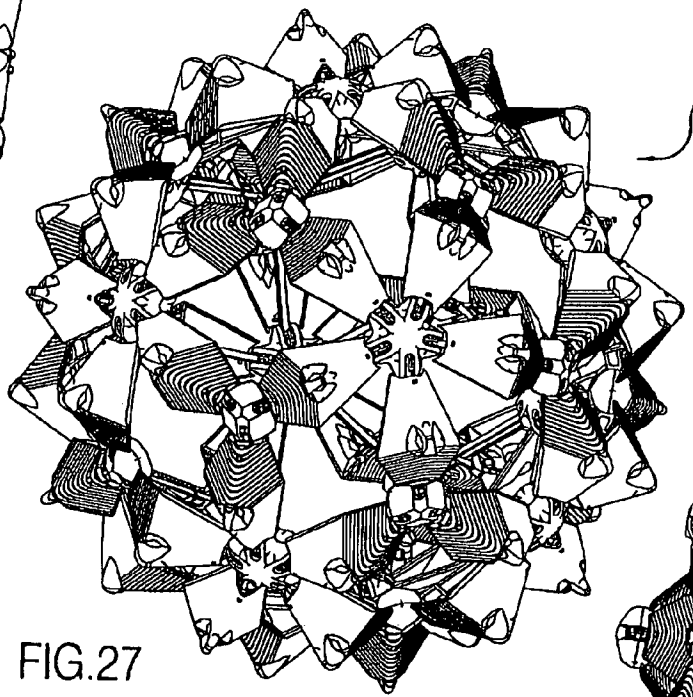
FIG. 27 is a perspective view of the structure of FIG. 26 in an unfolded condition.

FIG. 27 shows structure 150 in an unfolded position such that the unstriped and striped portions of the covered links are exposed.

Figure 28:
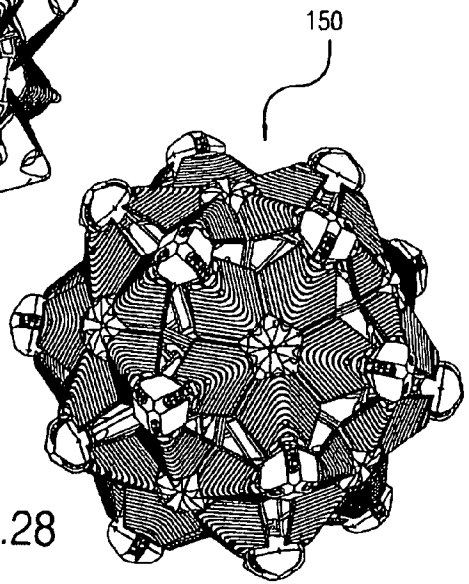
FIG. 28 is a perspective view of the structure of FIG. 26 in a folded condition.

FIG. 28 shows structure 150 in an alternate folded position such that the striped portions of the covered links are exposed, whereas the unstriped portions of the covered links are hidden. Effectively, structure 150 when viewed in the three states shown in FIGS. 26-28, is a "color-changing shape" made in accordance with the invention.

Figures 29, 30, 31:
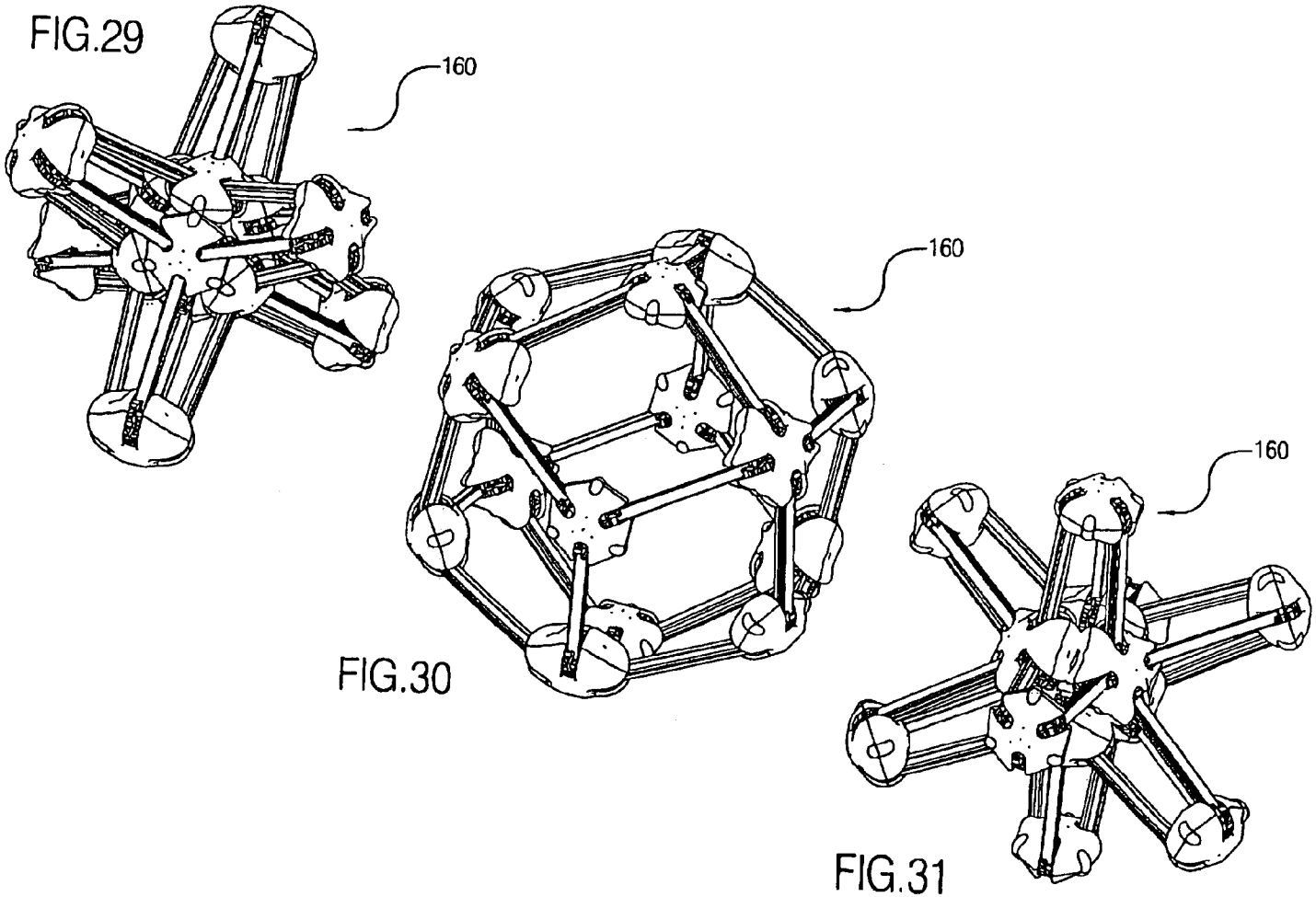
FIG. 29 is a perspective view of still a further structure made in accordance with the invention.
FIG. 30 is a perspective view of the structure of FIG. 29 in an unfolded condition.
FIG. 31 is a perspective view of the structure of FIG. 29 in a folded condition.

FIG. 29 shows an alternate embodiment of the invention. Structure 160 comprised of twenty-four links, six four-sided hubs and eight three-sided hubs. Structure 160 is shown in a folded position where the eight three-sided hubs are in close proximity to each other.

FIG. 30 shows structure 160 in an unfolded position. FIG. 31 shows structure 160 in an alternative folded position where the six four-sided hubs are in close proximity to each other.

Figure 32:
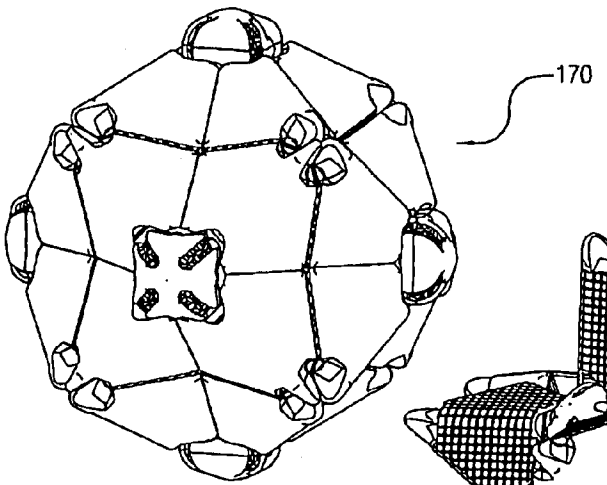
FIG. 32 is a perspective view of a structure similar to the structure of FIGS. 29-31 in which covering elements are applied.

FIG. 32 shows a structure 170 which is similar to structure 160, having twenty-four links, six four-sided hubs and eight three-sided hubs. The difference between the two structures is that the links belonging to structure 170 have covering elements attached. Structure 170 is shown in a folded position where the eight three-sided hubs are hidden from view.

Figure 33:
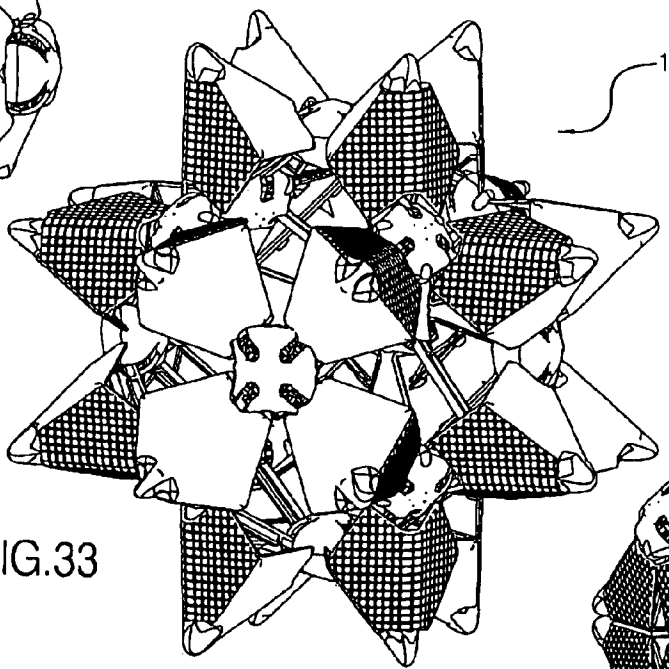
FIG. 33 is a perspective view of the structure of FIG. 32 in an unfolded condition.
Figure 34:
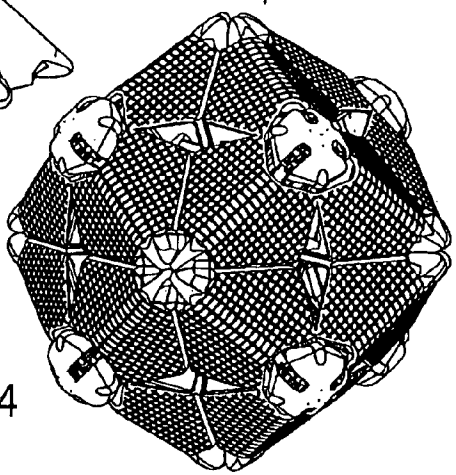
FIG. 34 is a perspective view of the structure of FIG. 32 in a folded condition.

FIG. 33 shows structure 170 in an unfolded position; the covering elements may be seen to have two regions: one shaded and one unshaded. FIG. 34 shows structure 170 in an alternate folded position where the six four-sided hubs are hidden from view. Only the shaded portions of the covering elements are exposed. Again, structure 170 when viewed in the three states shown in FIGS. 32-34 is a "color-changing shape" made in accordance with the invention.

Figure 35:
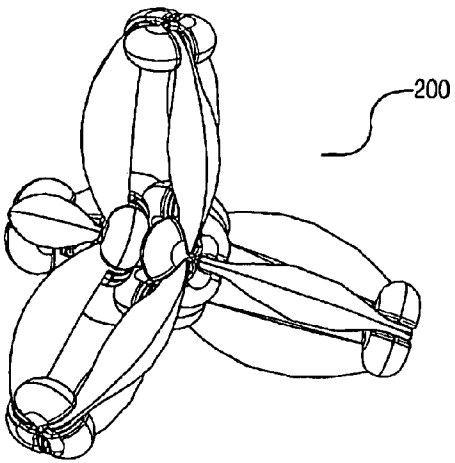
FIG. 35 is a perspective view of yet another structure made in accordance with the invention.

FIG. 35 shows an alternate embodiment of the invention, a structure 200 comprised of twelve links and eight three-sided hubs. Structure 200 is shown in a folded position.

Figure 36:
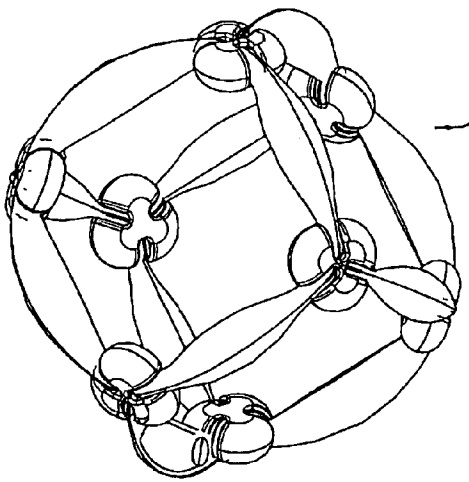
FIG. 36 is a perspective view of the structure of FIG. 35 in an unfolded condition.
Figure 37:
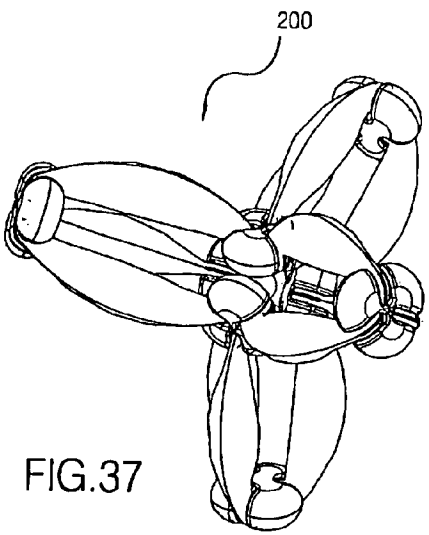
FIG. 37 is a perspective view of the structure of FIG. 35 in a folded condition.

FIGS. 36 and 37 show structure 200 in an unfolded and folded positions respectively.

Figure 38:
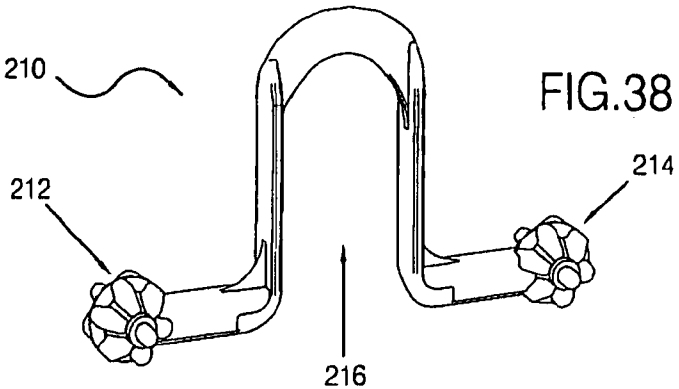
FIG. 38 is a perspective view of a link made in accordance with the invention comprising two gear ends having a bent central portion.

FIG. 38 shows a link 210 comprised of two gear-ends 212 and 214 and a central structural region 216. Region 216 has a bent portion which allows link 210 to flexibly deform when its ends are pressed towards each other.

Figure 39:
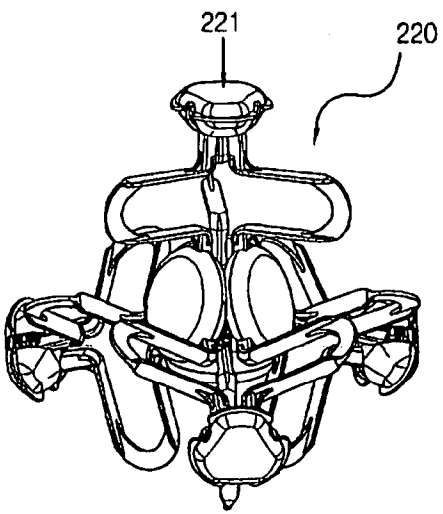
FIG. 39 is a perspective view of yet a further structure made in accordance with the invention and incorporating links of the type depicted in FIG. 38.

FIG. 39 shows a structure 220 comprised of twelve links and eight three-sided hubs. Structure 220 is shown in its folded position. Hub 221 is shown in an apex position within structure 220. When a compressive force is applied to hub 221 the bent portions in three of the links allow these links to flexibly deform, thus allowing hub 221, to be pressed towards the center of structure 220.

Figure 40:
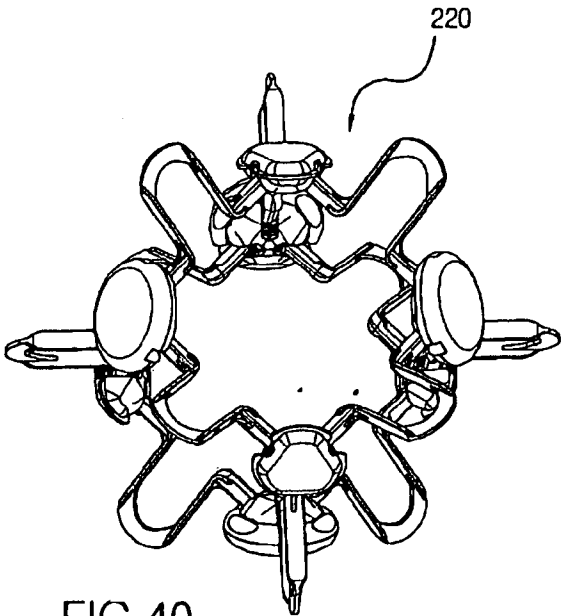
FIG. 40 is a perspective view of the structure of FIG. 39 in an unfolded condition.
Figure 41:
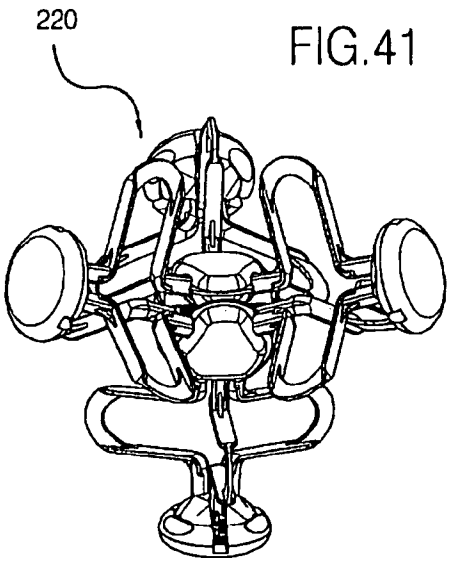
FIG. 41 is a perspective view of the structure of FIG. 39 in a folded condition.

FIGS. 40 and 41 show structure 220 in an unfolded and an alternate folded position respectively.

Figure 42:
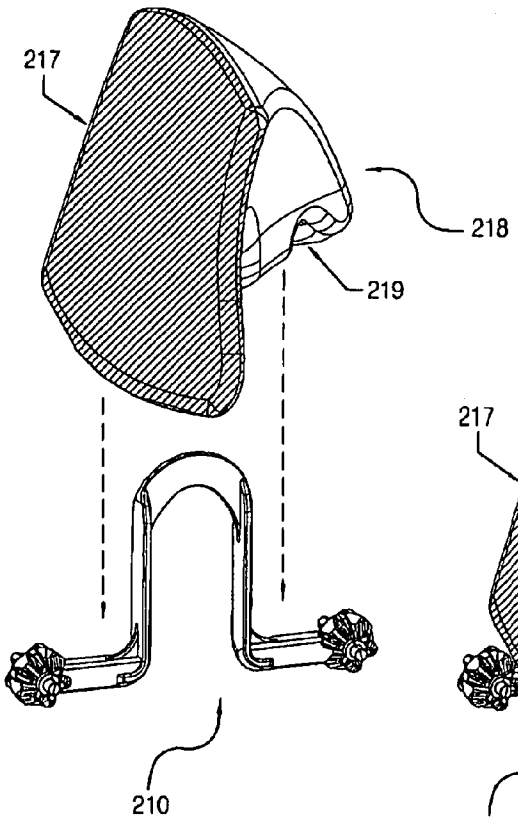
FIG. 42 is an exploded perspective view of the link of FIG. 38 and a covering element.

FIG. 42 shows link 210 with a covering element 218 shown in an exploded view above it. Covering element 218 is comprised of a mass of a flexible material, such as foam or rubber covering element 218 has a shaded region 217 and an unshaded region 219.

Figure 44:
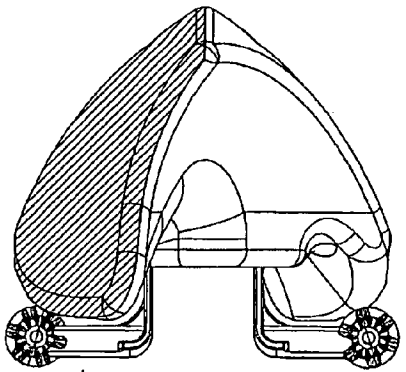
FIG. 44 is a perspective view in elevation of the link and covering element shown in FIG. 43.
Figure 45:
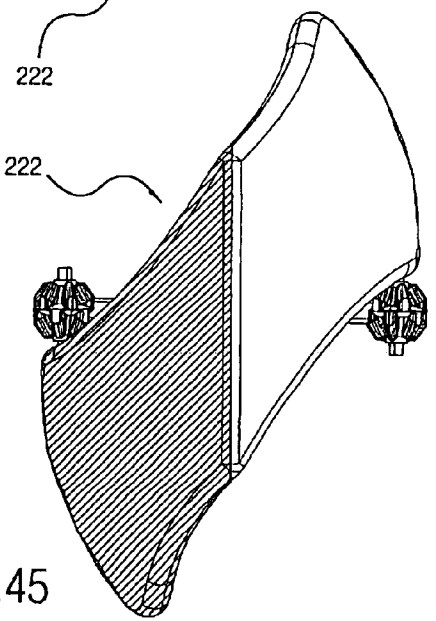
FIG. 45 is a plan perspective view of the link and covering element depicted in FIG. 43.
Figure 43:
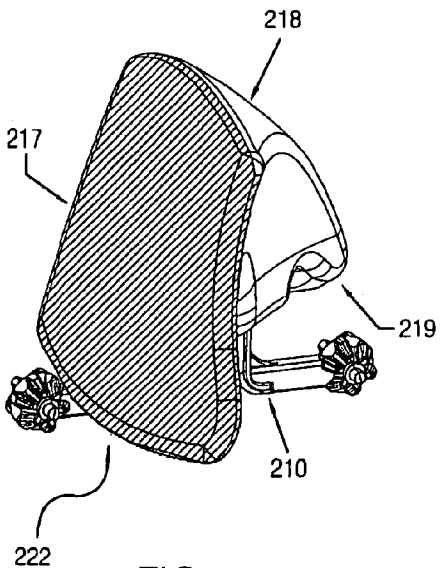
FIG. 43 is a perspective view of the link of FIG. 38 with the covering element applied.

FIG. 43 shows link 210 and covering element 218 joined together to form covered link 222. FIGS. 44 and 45 show covered link 222 in elevation and plan views respectively.

Figure 46:
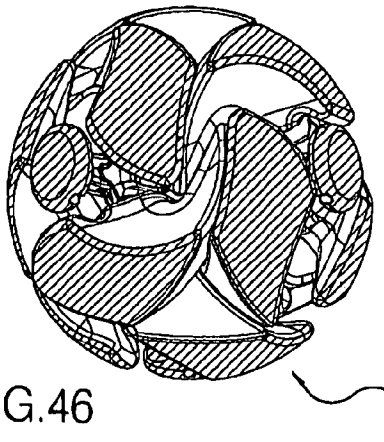
FIG. 46 is a perspective view of an additional structure made in accordance with the invention.

FIG. 46 shows a spherical structure 230 which is similar to structure 220, the difference being that the links in structure 230 are covered. Structure 230 is in a folded position. The shaded regions of the twelve links are exposed in this view. The exposed hubs are shown to be shaded as well.

The surface of structure 230 is compliant and flexible due to the covering elements material properties. Further, the hubs are equally compliant due to the flexible properties of the links.

Figure 47:
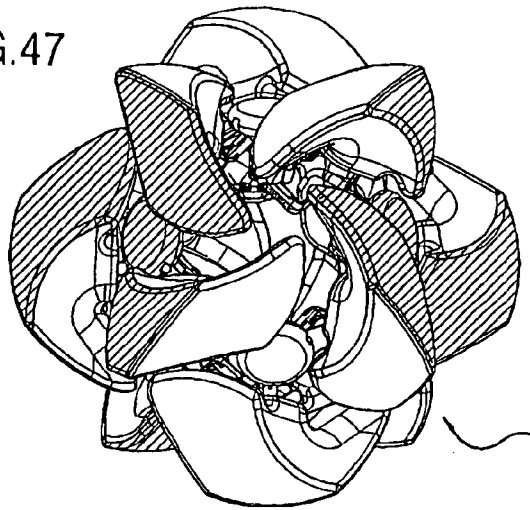
FIG. 47 is a perspective view showing the structure of FIG. 46 in an unfolded condition.

FIG. 47 shows structure 230 in an unfolded position where the shaded and unshaded regions of the twelve links are exposed.

Figure 48:
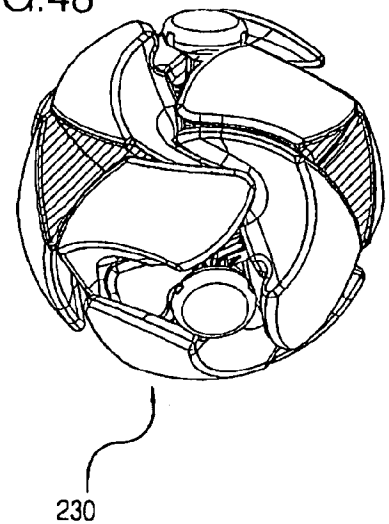
FIG. 48 is a perspective view showing the structure of FIG. 46 in a folded condition.

FIG. 48 shows structure 230 in an alternate folded position where the unshaded regions of the twelve links are exposed. The exposed hubs are unshaded as well. Thus structure 230 is effectively a "color-changing ball".

Figure 49:
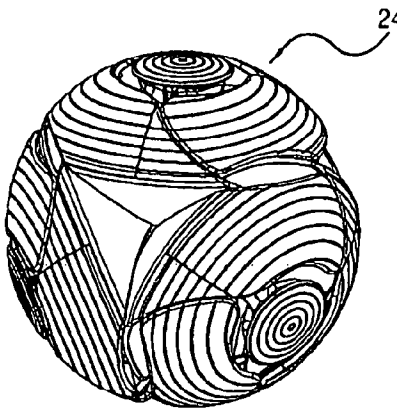
FIG. 49 of yet another alternative structure in accordance with the invention.
Figure 50:
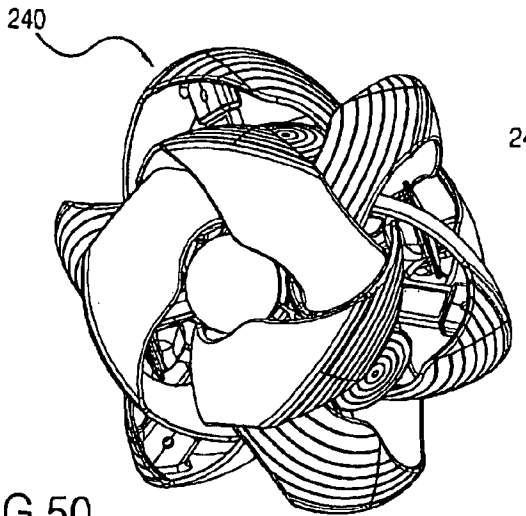
FIG. 50 is a perspective view of the structure of FIG. 49 in an unfolded condition.
Figure 51:
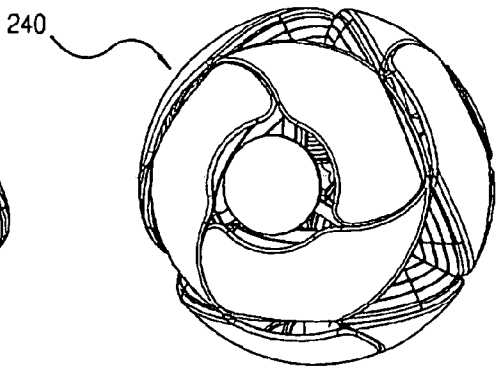
FIG. 51 is a perspective view of the structure of FIG. 49 in a folded condition.

FIGS. 49-51 show structure 240 in three states (folded state, unfolded state and alternate folded state respectively). Structure 240 is an alternate embodiment of a color-changing ball.

Figure 52:
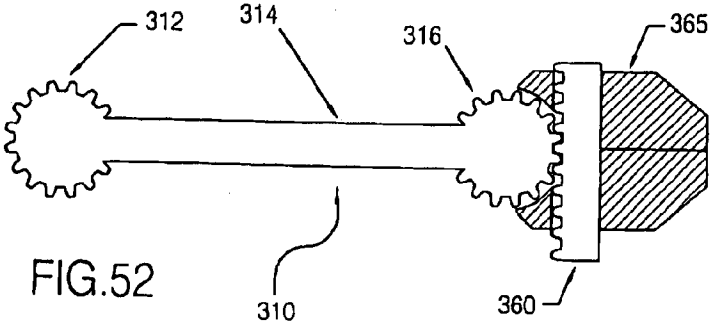
FIG. 52 is a plan view in cross section of a two spur gear end link made in accordance with the invention.

FIG. 52 shows a sectional view of a link 310 which is comprised of two gear ends 312 and 316 connected by a linear element 314. Gear ends 312 and 316 are spur gears rather than bevel gears. Gear end 316 is engaged with linear gear (rack) 360 which can slide within hub 365.

Figure 53:
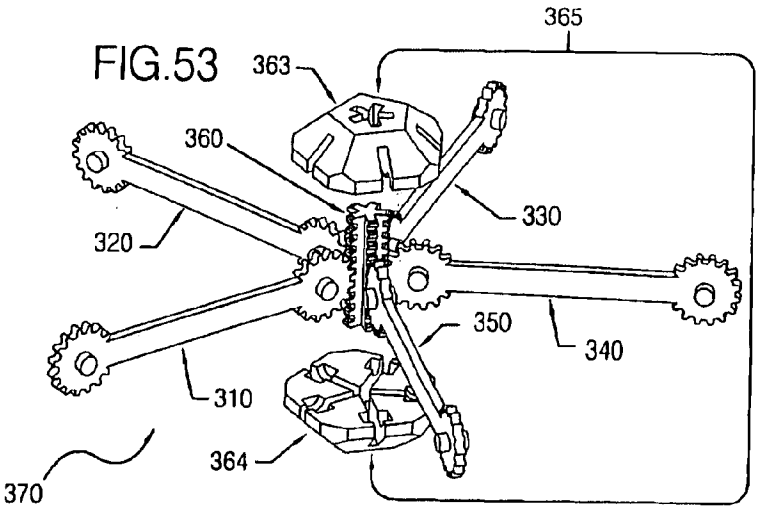
FIG. 53 is an exploded perspective view of an assembly utilizing the links of FIG. 52.

FIG. 53 shows an assembly 370 comprised of five links 310, 320, 330, 340 and 350 each having gear ends which are spur gears. One gear end each of the five links is engaged with linear gear 360. Hub 365 is shown in exploded view comprised of two halves 363 and 364.

Figure 56:
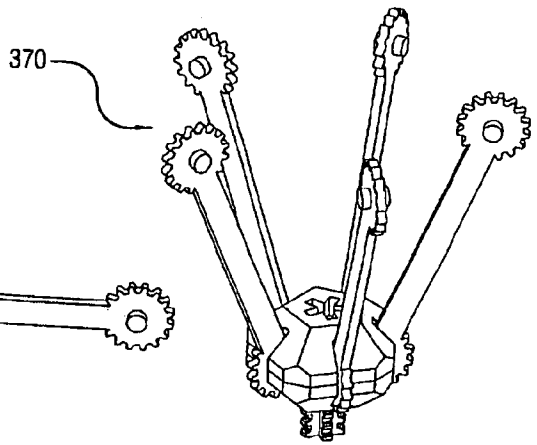
FIG. 56 is a perspective view of the assembly of FIG. 53 in a second folded condition.
Figure 55:
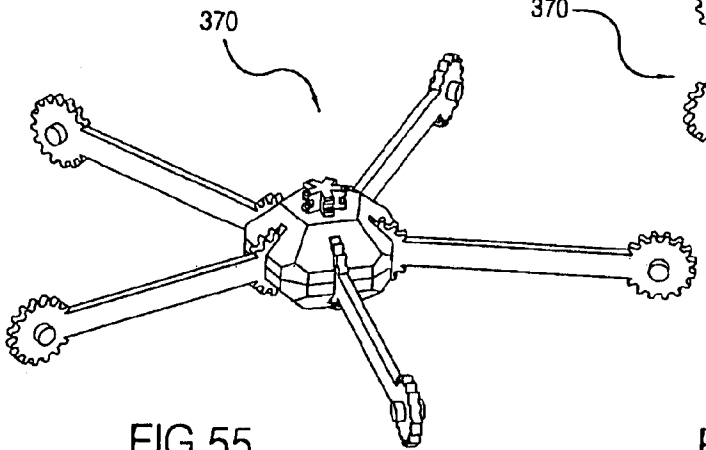
FIG. 55 is a perspective view of the assembly of FIG. 53 in an unfolded condition.
Figure 54:
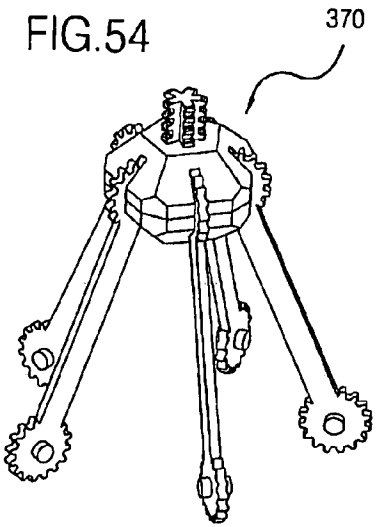
FIG. 54 is a perspective view of the assembly of FIG. 53 in a first folded condition.

FIGS. 54-56 show assembly 370 in three positions. As the five links rotate they drive the linear gear up and down and are thereby synchronized to one another. This alternate embodiment of the invention utilizing spur gears and racks is functionally equivalent to the embodiments that utilize bevel gears.

Figure 57:
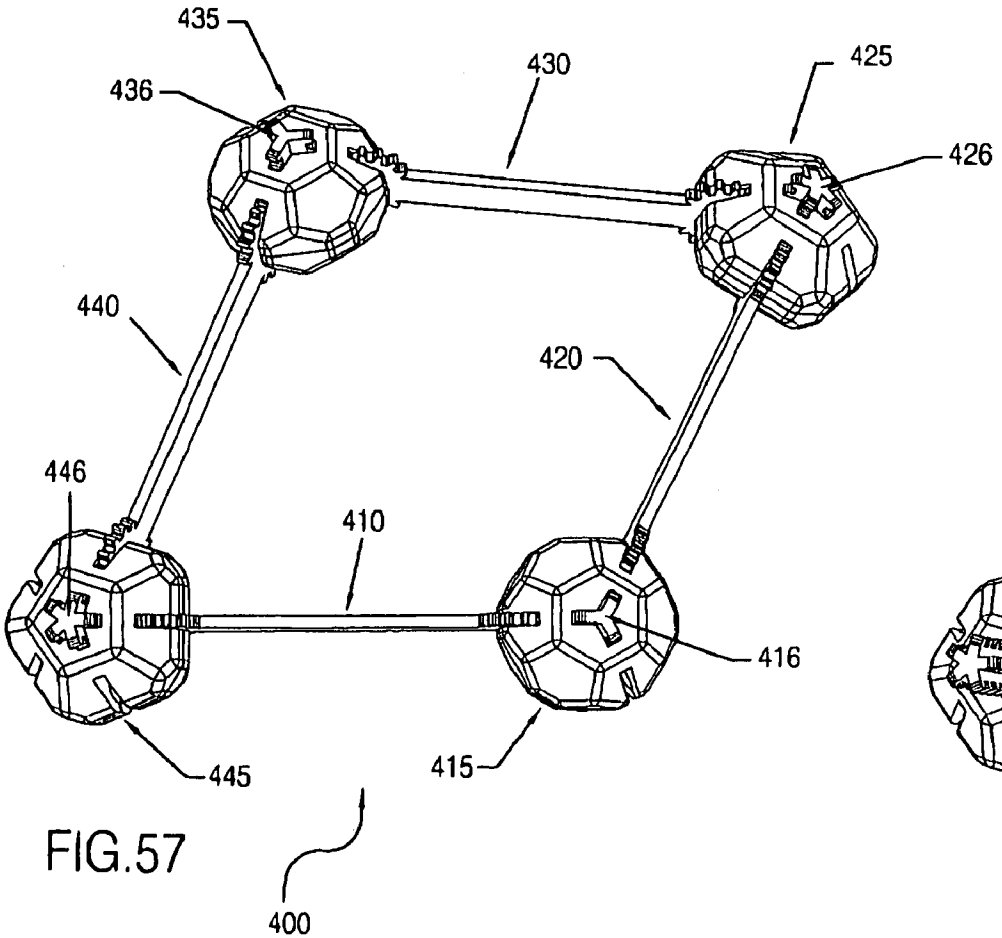
FIG. 57 is a perspective view of a loop assembly consisting of four links with interconnecting hubs utilizing the links of FIG. 52.

FIG. 57 shows a loop assembly 400 comprised of four links 410, 420, 430 and 440 each having spur gear ends. Also comprised within assembly 400 are four hubs 415, 425, 435 and 445, each containing linear gears 416, 426, 436 and 446 respectively.

Figure 58:
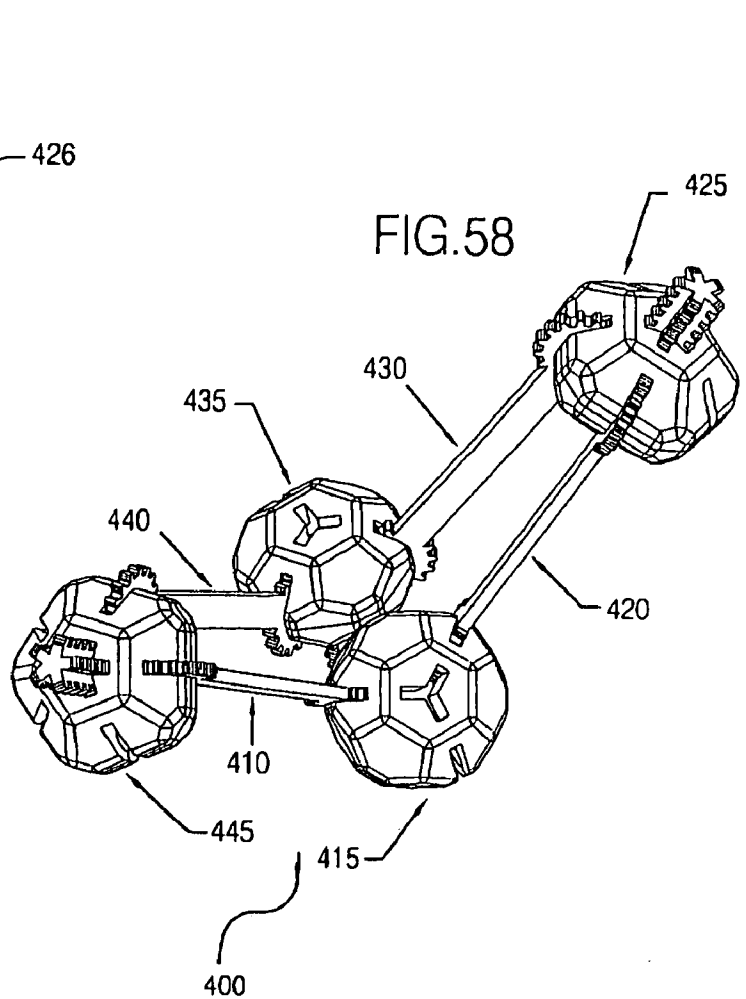
FIG. 58 is a perspective view of the loop assembly of FIG. 57 in a folded condition.

FIG. 58 shows loop assembly 400 in a folded position.

It will thus be see that the objects set forth above, among those made apparent from the preceding description, are efficiently attained and, since certain changes may be made in the construction of the inventive structure without departing from the spirit and scope of the invention, it is intended that all matter contained in the above description as shown in the accompanying drawings shall be interpreted as illustrative and not in a limiting sense.

It is also to be understood that the following claims are intended to cover all of the general and specific features of the invention described herein and all statements of the scope of the invention which, as a matter of language, might be said to fall therebetween.

The invention claimed is:

1. A foldable loop assembly comprising at least four links, each said link having a first end with a gear for defining a rotational axis line and a second end with a gear for defining a rotational axis line;

wherein said gear of said first end of any one of said links is rotatably engaged to said gear of said second end of another of said links in order to define four pairs of rotatably engaged gears such that said first end axis line and said second end axis line of each said pair of engaged gears lie in a single plane for any rotational positions thereof;

wherein each pair of engaged gears defines a vector which is orthogonal in direction to the single plane in which said axis lines of said pair of engaged gears lie;

wherein the vector defined by any of said pairs of engaged gears and the vector defined by any other pair of engaged gears together define an angle which remains constant in any folded condition of said assembly.

2. The assembly of claim 1, wherein each of said gears comprises at least one beveled gear.

3. The assembly of claim 1, wherein each of said pairs of engaged gears is retained within a hub element.

4. The assembly of claim 3, wherein each said hub element includes a slot through which said link depending from the gear retained therewithin rotatably extends.

5. The assembly of claim 1, further including at least one covering element selectively attached to at least one of said links.

6. The assembly of claim 5, wherein said at least one covering element includes a first outside surface having a first visual presentation and a second outside surface having a second visual presentation different from said first visual presentation.

7. The assembly of claim 6, wherein said assembly is foldable in a first folded condition such that only said first visible presentation of said at least one covering element is exposed and in a second folded condition such that only said second visible presentation of said at least one covering element is exposed.

8. The assembly of claim 1, wherein at least one of said links has a central bent portion.

9. The assembly of claim 8, further including at least one covering element selectively attached to said at least one of said links.

10. The assembly of claim 9, wherein said at least one covering element is made of a flexible material.

11. The assembly of claim 10, wherein said at least one covering element includes a first outside surface having a first visual presentation and a second outside surface having a second visual presentation different from said first visual presentation.

12. The assembly of claim 1, wherein each of said gears comprises a spur gear.

13. The assembly of claim 12, wherein each of said pairs of engaged gears are engaged by means of a linear gear.

14. The assembly of claim 13, wherein each of said pairs of said engaged gears and said corresponding linear gears are retained within a hub element.

15. The assembly of claim 14, wherein said at least four links comprise an even number of links.

* * * * *